US007513317B2

(12) United States Patent
Satou

(10) Patent No.: US 7,513,317 B2
(45) Date of Patent: Apr. 7, 2009

(54) IMPACT TOOL WITH VIBRATION CONTROL MECHANISM

(75) Inventor: Shinichirou Satou, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/682,937

(22) Filed: Mar. 7, 2007

(65) Prior Publication Data

US 2008/0277128 A1 Nov. 13, 2008

(30) Foreign Application Priority Data

Mar. 7, 2006 (JP) ..... P2006-060969

(51) Int. Cl.
*B25D 11/00* (2006.01)

(52) U.S. Cl. ..... 173/162.2; 173/48; 173/109; 173/201

(58) Field of Classification Search ..... 173/48, 173/201, 162.1, 162.2, 217, 2, 104, 109, 173/210, 211
See application file for complete search history.

(56) References Cited

U.S. PATENT DOCUMENTS

| | | | | |
|---|---|---|---|---|
| 1,845,825 | A * | 2/1932 | Benedict | 173/162.2 |
| 3,305,031 | A | 2/1967 | Bez et al. | |
| 4,282,938 | A * | 8/1981 | Minamidate | 173/162.2 |
| 4,478,293 | A * | 10/1984 | Weilenmann et al. | 173/162.2 |
| 4,836,297 | A * | 6/1989 | Dorner et al. | 173/162.1 |
| 5,447,295 | A * | 9/1995 | Taomo | 267/153 |
| 5,975,217 | A * | 11/1999 | Frenzel et al. | 173/201 |
| 6,076,616 | A * | 6/2000 | Kramp et al. | 173/162.2 |
| 6,112,831 | A * | 9/2000 | Gustafsson | 173/162.2 |
| 6,484,814 | B2 * | 11/2002 | Bongers-Ambrosius | 173/2 |
| 6,843,330 | B2 * | 1/2005 | Schmid et al. | 173/217 |
| 6,907,943 | B2 * | 6/2005 | Ikuta | 173/117 |
| 6,962,211 | B2 * | 11/2005 | Daubner et al. | 173/162.2 |
| 6,981,557 | B2 * | 1/2006 | Boeni et al. | 173/1 |
| 6,983,807 | B2 * | 1/2006 | Mayr et al. | 173/48 |
| 7,059,425 | B2 * | 6/2006 | Ikuta | 173/128 |
| 7,076,838 | B2 * | 7/2006 | Meixner | 16/431 |
| 7,252,157 | B2 * | 8/2007 | Aoki | 173/162.2 |
| 7,320,369 | B2 * | 1/2008 | Stirm et al. | 173/162.2 |
| 7,331,407 | B2 * | 2/2008 | Stirm et al. | 173/201 |
| 7,451,833 | B2 * | 11/2008 | Hahn | 173/104 |

FOREIGN PATENT DOCUMENTS

| | | |
|---|---|---|
| EP | 0 066 779 | 12/1982 |
| EP | 1 170 095 | 1/2002 |
| EP | 1 439 038 | 7/2004 |
| EP | 1 464 449 | 10/2004 |
| EP | 1 637 289 | 3/2006 |
| EP | 1 767 315 | 3/2007 |
| JP | 2004-299036 | 10/2004 |

* cited by examiner

*Primary Examiner*—Scott A. Smith
(74) *Attorney, Agent, or Firm*—Antonelli, Terry, Stout & Kraus, LLP.

(57) ABSTRACT

An impact tool is provided that can efficiently reduce the vibration resulting from the striker and that does not lead to a larger design even with the use of a counterweight mechanism. A counterweight mechanism is provided in a motion converter housing, facing the handle. The counterweight mechanism is positioned between a center of gravity of the impact tool and the grip of the handle and is positioned above the control substrate. The counterweight mechanism is equipped with a first support, a second support, a weight support member, and a counterweight.

14 Claims, 9 Drawing Sheets

IMPACT TOOL WITH VIBRATION CONTROL MECHANISM

BACKGROUND OF THE INVENTION

1. Field of the Invention

The present invention relates to an impact tool, and more specifically to an impact tool having a vibration control mechanism.

2. Description of the Related Art

Conventionally, electrical power tools having vibration control mechanisms have been proposed. For example, Japanese Patent Application Publication No. 2004-299036 discloses an electrical power tool including a casing that has a handle, a motor housing, and a gear housing connected with one another. An electrical motor is accommodated in the motor housing. The gear housing has a motion conversion housing, a vibration control housing, and an impact housing. A motion conversion mechanism that converts a rotation motion of the electrical motor into a reciprocation motion is provided in the motion conversion housing. A cylinder extending a direction perpendicular to the rotation axis of the electrical motor is provided in the impact housing. A tool support portion is provided on the front side of the cylinder and is capable of attaching or detaching a working tool.

A piston is provided in the cylinder and is slidably provided along the inner periphery of the cylinder. The piston reciprocates along the inner periphery of the cylinder by the motion conversion mechanism. A striking member is provided in the front section of the cylinder and is slidably provided along the inner periphery of the cylinder. An air chamber is formed in the cylinder between the piston and the striking member. An intermediate member is provided in the front side of the striking member and is slidably provided back-and-forth within the cylinder. The working tool mentioned above is positioned at the front side of the intermediate element.

The vibration control housing is provided on the side of the impact housing and communicates with the impact housing by way of an air channel. A space formed by the piston, the cylinder, the impact housing, the counterweight, and the vibration control housing is formed as a sealed space. A counterweight and two springs are provided in the vibration control housing. The counterweight is capable of moving a reciprocation motion parallel to the reciprocation motion of the piston. The two springs are positioned at the ends of the counterweight.

The rotational driving force of the electrical motor is transmitted to the motion conversion mechanism, and the motion conversion mechanism moves the piston in the cylinder in the reciprocation motion. The reciprocation motion of the piston repeatedly increases and decreases the pressure of the air in the air chamber, thereby applying an impact force to the striking member. The striking member moves forward and collides with the rear end of the intermediate member, thereby applying the impact force to the working tool. The workpiece is fractured by the impact force applied to the working tool.

During the operation of the electrical power tool, when the piston moves forward, the counterweight moves rearward because the space formed by the piston, the cylinder, the impact housing, the counterweight, and the vibration control housing is a sealed space. Conversely, when the piston moves rearward, the counterweight moves forward. Thus, in this structure, the counterweight reciprocates in conjunction with the reciprocation motion of the piston.

However, in the electrical power tool described above, when the counterweight vibrates, the friction between the two springs and the vibration control housing prevents the counterweight from vibrating efficiently. Thus, the vibration caused by the striking member cannot be reduced efficiently. The vibration control housing is provided on the side of the impact housing, the electrical power tool, thereby leading to as increased size in the electrical power tool.

SUMARY OF THE INVENTION

In view of the foregoing, it is an object of the present invention to provide an impact tool that is capable of efficiently reducing the vibration resulting from the striking member and that does not lead to an increased size even with the use of a counterweight mechanism.

The above and other objects of the present invention can be attained by an impact tool including: a housing, a motor, a reciprocating motion converter, a tool bit, a handle, and a counterweight mechanism. The motor has a rotation shaft, is accommodated in the housing and generates a rotational drive force when powered. The reciprocating motion converter is configured to convert the rotational drive force of the motor to a reciprocating motion reciprocating in directions perpendicular to the rotation shaft of the motor. The tool bit is attached to one end portion of the housing and driven by the reciprocating motion of the reciprocating motion converter. The handle is positioned at another end portion of the housing. The counterweight mechanism is operable to reduce vibrations generated attendant to the reciprocating motion. Such counterweight mechanism is disposed in a section of the housing, the section being in confrontation with the handle.

In the impact tool thus arranged, the counterweight mechanism is disposed in the section of the housing and the section in which the counterweight mechanism is disposed is in confrontation with the handle. Thus, the size of the impact tool does not increase even with the presence of the counterweight mechanism.

It is preferable to further include a control substrate configured to control the rotational drive force generated by the motor wherein the control substrate is disposed in confrontation with the section in which the counterweight mechanism is disposed.

With such an arrangement, an open space in the housing facing the substrate can be used efficiently, and the size of the impact tool does not increase even with the presence of the counterweight mechanism.

It is also preferable to include a transfer shaft interposed between the rotation shaft of the motor and the reciprocating motion converter. The transfer shaft transfers the rotational drive force generated by the motor to the reciprocating motion converter, wherein the counterweight mechanism is disposed between the transfer shaft and the handle.

It is preferable that the counterweight mechanism include a counterweight and a counterweight support member supporting the counterweight, and wherein a center of gravity of the counterweight is positioned further toward the reciprocating motion converter than a line passing through the center of gravity and extending in parallel to the directions of the reciprocating motion.

Preferably, the handle has a grip. The counterweight is disposed between the grip and a center of gravity of the impact tool. Thus, it is possible to reduce the rotational moment centered around the center of gravity G resulting from the reciprocating motion of the reciprocating motion converter.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
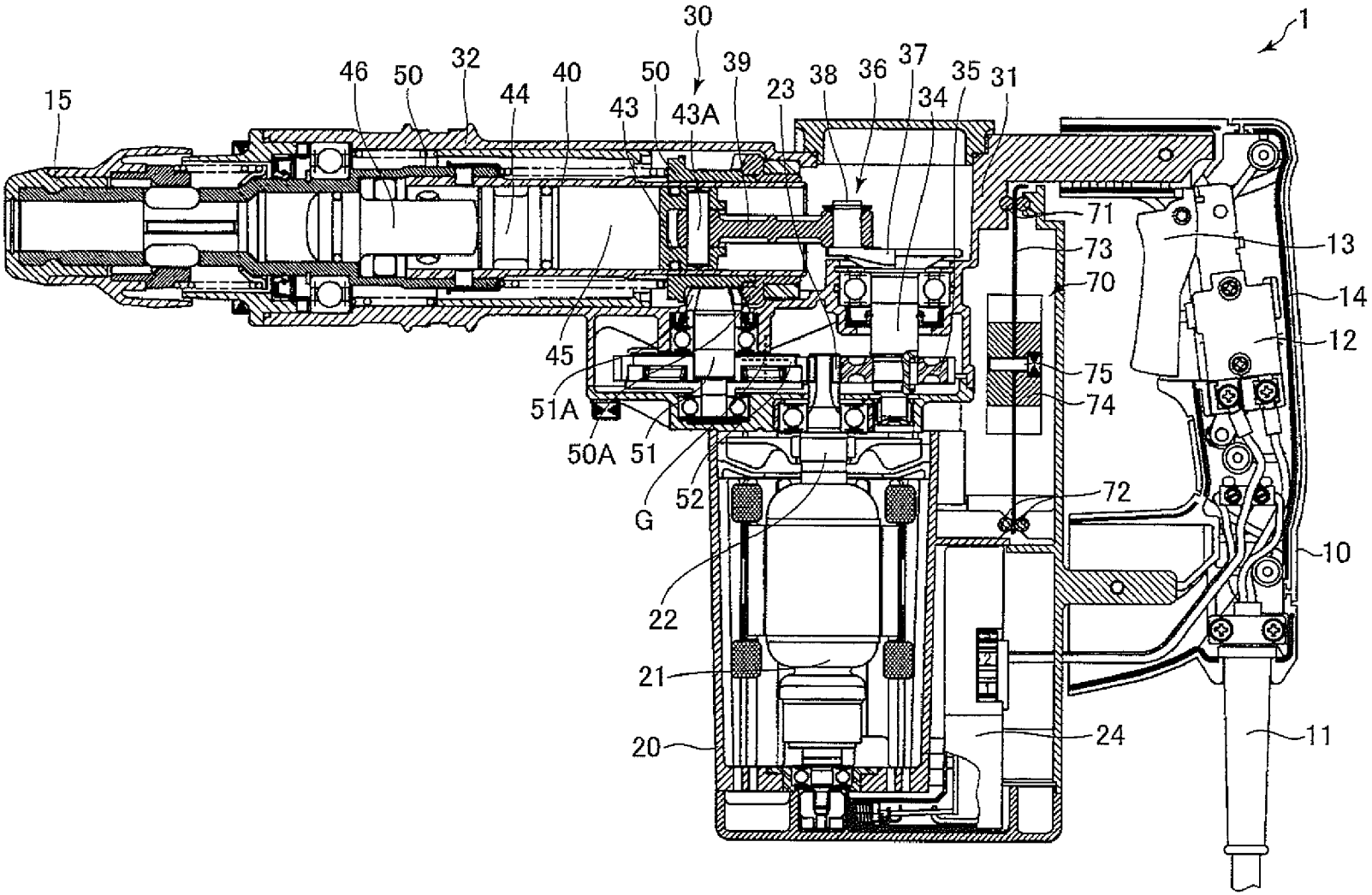
FIG. 1 is a cross-sectional view showing an impact tool according to a first embodiment of the present invention.
Figure 2:
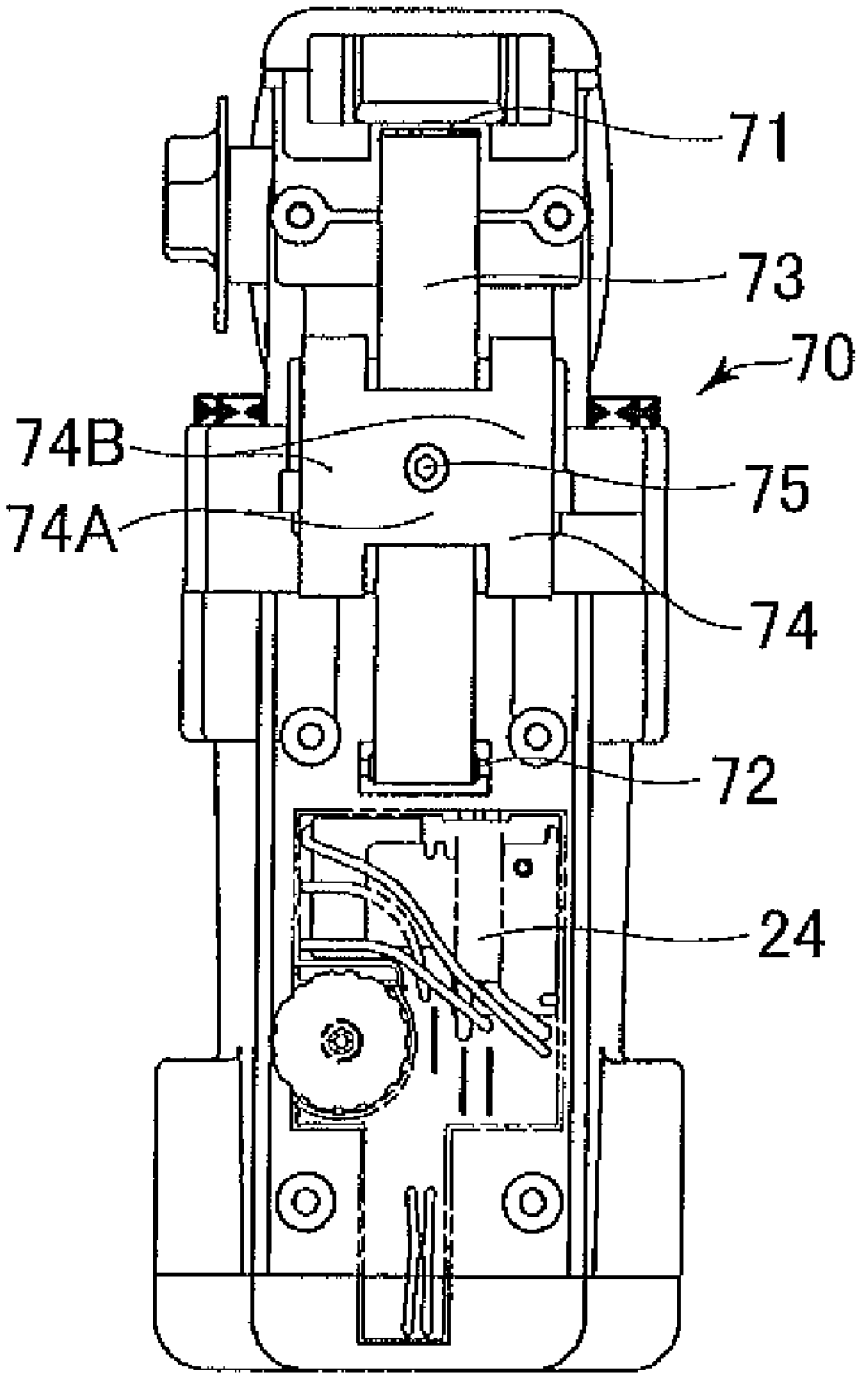
FIG. 2 is a rear-view of a counterweight mechanism of the impact tool according to the first embodiment of the present invention.

An impact tool according to a first embodiment of the present invention will be described while referring to FIGS. 1 and 2. In FIG. 1, the left side will be described as the front side of the impact tool 1 and the right side will be described as the back side of the impact tool 1. The impact tool 1 includes a casing having a handle 10, a motor housing 20, and a gear housing 30 connected with one another.

A power cable 11 is attached to the handle 10. The handle 10 houses a switch mechanism 12. A trigger 13 that can be manipulated by the user is mechanically connected to the switch mechanism 12. The switch mechanism 12 is connected to an external power source (not shown) through the power cable 11. By operating the trigger 13, an electrical motor 21 described later can be connected to and disconnected from the external power source. Also, the handle 10 includes a grip 14 that is gripped by the user when the impact tool 1 is used.

The motor housing 20 is positioned at a lower front side of the handle 10. The electrical motor 21 is accommodated in the motor housing 20. The electrical motor 21 includes an output shaft 22 that outputs a driving force of the electrical motor. A pinion gear 23 is provided on the end of the output shaft 22 and is positioned in the gear housing 30. A control unit 24 for controlling a rotation speed of the electrical motor 21 is located on the motor housing 20 behind the electrical motor 21.

The gear housing 30 includes a motion conversion housing 31 and a hammer housing 32. The motion conversion housing 31 is positioned above the motor housing 20 and a rear end of the motion conversion housing 31 is connected to the handle 10. The hammer housing 32 is positioned above the motor housing 20.

A crank shaft 34 that extends parallel to the output shaft 22 is rotatably supported on the rear side of the pinion gear 23 in the motion conversion housing 31. A first gear 35 that meshingly engaged with the pinion gear 23 is coaxially fixed to the lower end of the crank shaft 34. A motion conversion mechanism 36 is provided at the upper side of the crank shaft 34. The motion conversion mechanism 36 includes a crank weight 37, a crank pin 38, and a connecting rod 39. The crank weight 37 is fixed to the upper end of the crank shaft 34. The crank pin 38 is fixed to the end portion of the crank weight 37. The crank pin 38 is inserted into the rear end of the connecting rod 39.

A rotation transmission shaft 51 extending parallel to the output shaft 22 is rotatably supported on the front side of the pinion gear 23 in the motion conversion housing 31. A second gear 52 that meshingly engaged with the pinion gear 23 is coaxially fixed to the lower end of a rotation transmission shaft 51. A first bevel gear 51A is coaxially fixed to the upper end of the rotation transmission shaft 51.

A cylinder 40 extending in a direction perpendicular to the output shaft 22 is provided in the hammer housing 32. The center axis of the cylinder 40 and the rotation axis of the output shaft 22 are positioned on a same plane. The rear end of the cylinder 40 opposes the electrical motor 21 in the axial direction of the output shaft 22. A piston 43 is provided in the cylinder 40 and is slidably provided along the inner periphery of the cylinder 40. The piston 43 reciprocates in the axial direction of the cylinder 40. The piston 43 includes a piston pin 43A that inserted into the front end of the connecting rod 39. A striking member 44 is provided in the front section of the cylinder 40 and is slidably provided along the inner periphery of the cylinder 40 in the axial direction thereof. An air chamber 45 is formed among the cylinder 40, the piston 43, and the hammer 44.

A rotating cylinder 50 is rotatably supported in the hammer housing 32. The rotating cylinder 50 surrounds the front section of the outer perimeter of the cylinder 40. The rotating cylinder 50 extends forward of the cylinder 40, and a tool support portion 15 is provided at the end of the rotating cylinder 50 and is capable of attaching or detaching a working tool (not shown) . A second bevel gear 50A that meshingly engaged with the first bevel gear 51A is provided on the rear end portion of the rotating cylinder 50. The center axis of the rotating cylinder 50 and the rotation axis of the output shaft 22 are positioned on a same plane. Also, an intermediate member 46 is provided in the front side of the striking member 44 and is slidably provided against the rotating cylinder 50. The intermediate member 46 reciprocates in the axial direction of the rotating cylinder 50.

A counterweight mechanism 70 is provided in the motion conversion housing 31 and in opposition to the handle 10. The counterweight mechanism 70 is positioned between a center of gravity G of the impact tool 1 and the grip 14 of the handle 10 and is positioned above the control unit 24. The counterweight mechanism 70 will be described while referring to FIGS. 1 and 2. The counterweight mechanism 70 includes a pair of support members 71, a pair of support members 72, a counterweight holding member 73, and a counterweight 74. The support members 71 and 72 are positioned on a plane perpendicular to the reciprocating direction of the piston 43. The support members 71 oppose the support members 72 on the plane. The pair of support members 71 is made from rubber and is fixed to the upper section of the motion conversion housing 31. The pair of support members 72 is made from steel roller and is fixed to the motion conversion housing 31.

The counterweight holding member 73 is made from a leaf spring. The upper end portion of the counterweight holding member 73 has an L-shaped, is positioned between the pair of support members 71 and is supported by the support members 71 with line contacts. Since the pair of support members 71 is made from rubber, the upper end portion of the counterweight holding member 73 is supported by the support members 71 while being capable of moving up and down with respect to the support members 71. The lower end portion of the counterweight holding member 73 is positioned between the pair of support members 72 and is supported by the support members 72 with line contacts. Since the pair of support members 72 is made from the steel roller, the lower end portion of the counterweight holding member 73 is supported by the support members 72 while being capable of moving up and down with respect to the support members 72. The counterweight 74 is fixed roughly in the vertical center of the counterweight holding member 73 using a bolt 75. The counterweight 74 is doubly supported at its both ends by the counterweight holding member 73. As shown in FIG. 2, the counterweight 74 includes a base 74A and two legs 74B. The base 74A extends in a direction perpendicular to the extending direction of the counterweight holding member 73 and is fixed to the counterweight holding member 73. Each of the two legs 74B is connected to the ends of the base 74A and extends along and is separated from the counterweight holding member 73. Hence, the counterweight 74 has an H-shaped.

Next, the operation of the impact tool 1 according to the first embodiment will be described. The working tool (not shown) is pressed against a workpiece (not shown) with the handle 10 gripped by the user. Next, the trigger 12 is pulled to supply power to and rotate the electrical motor 21. This rotation driving force is transmitted to the crank shaft 34 by way of the pinion gear 23 and the first gear 35. The rotation of the crank shaft 34 is converted into reciprocation motion of the piston 43 in the cylinder 40 by the motion converter mechanism 36 (the crank weight 37, the crank pin 38, and the connecting rod 39). The reciprocation motion of the piston 43 leads to repeated increments and decrements the pressure of the air in the air chamber 45, thereby causing a reciprocation motion of the striking member 44. The striking member 44 moves forward and collides with the rear end of the intermediate member 46, thereby applying an impact force to the working tool (not shown).

Also, the rotation driving force of the electrical motor 21 is transmitted to the pinion gear 23, the second gear 52, and the rotation transmission shaft 51. The rotation of the rotation transmission shaft 51 is transmitted to the rotating cylinder 50 by way of the first bevel gear 51A and the second bevel gear 50A, resulting in rotation of the rotating cylinder 50. The rotation of the rotating cylinder 50 applies a rotation force to the working tool (not shown). The workpiece (not shown) is fractured by the rotation force and the impact force described above applied to the working tool (not shown).

During the operation of the impact tool 1 described above, a vibration with a roughly constant frequency resulting from the reciprocation motion of the striking member 44 is generated in the impact tool 1. The vibration is transmitted to the support members 71 and 72 by way of the motion conversion housing 31. The vibration transmitted to the support members 71 and 72 is transmitted to the counterweight holding member 73 and the counterweight 74, leading to the counterweight 74 vibrating in a direction that the piston 43 reciprocates. The vibration of the impact tool 1 can be reduced by the vibration of the counterweight 74, thereby improving the operation of the impact tool 1.

More specifically, the vibration of a frequency band having a constant width centering on a resonance frequency is reduced by the vibration of the counterweight 74. The resonance frequency is determined by the counterweight 74 and the counterweight holding member 73 which is a leaf spring. The resonance frequency is set up to be roughly identical to the frequency of the vibration generated by the impact of the impact tool 1. A resonance frequency (resonance point) f is $f=1/(2\pi)((k_1+k_2)/m)^{1/2}$, where the spring constants of the counterweight holding member 73 made from the leaf spring are $k_1$ (the spring constant of the counterweight holding member 73 positioned higher than the counterweight 74), $k_2$ (the spring constant of the counterweight holding member 73 positioned lower than the counterweight 74), and the mass of the counterweight 74 is m. Practically, the actual resonance frequency band will be slightly wider and slightly lower than the theoretical resonance frequency band due to the influence of damping and the like. Thus, the resonance point determined from the above equation is set to be slightly higher than the vibration frequency of the impact tool 1.

Since the counterweight 74 is doubly supported on both ends by the counterweight holding member 73 as described above, rotation moment that would be generated with a cantilevered counterweight can be prevented. Also, the ends of the counterweight holding member 73 are movably supported with respect to the support members 71 and 72. Hence, no friction is generated between the motion conversion housing 31 and the counterweight 74 and the counterweight holding member 73 made from the leaf spring. Accordingly, the counterweight holding member 73 and the counterweight 74 can be vibrated smoothly in the same directions as the directions for the reciprocation motion of the piston 43. Thus, the vibration of the impact tool 1 caused by the reciprocation motion of the striking member 44 can be efficiently reduced, thereby improving the operation of the impact tool 1. Also, since the upper end of the counterweight holding member 73 is the L-shaped, the counterweight holding member 73 can be prevented from slipping out from the support members 71. Furthermore, the counterweight 74 is the H-shaped. As a result, the length of the counterweight holding member 73 needed to obtain a desired resonance frequency can be reduced, thereby providing a compact overall size for the counterweight mechanism 70.

Since the counterweight mechanism 70 is positioned above the control unit 24 and is disposed in opposition to the handle 10, the open space above the control unit 24 can be used effectively and enlargement of the impact tool 1 by providing the counterweight mechanism 70 can be prevented. The counterweight mechanism 70 is positioned between the grip 14 and the center of gravity G of the impact tool 1. Therefore, the rotation moment centering on the center of gravity G caused by the reciprocation motion of the piston 43 can be reduced. Also, since springs supporting the counterweight 74 are not placed at ends of the counterweight 74 in the directions of the reciprocation motion of the piston 43, as in conventional impact tools, frication between the housing, and the springs and the counterweight 74 can be prevented. Thus, the vibration of the counterweight 74 can be stabilized and efficiently absorbed.

Figure 3:
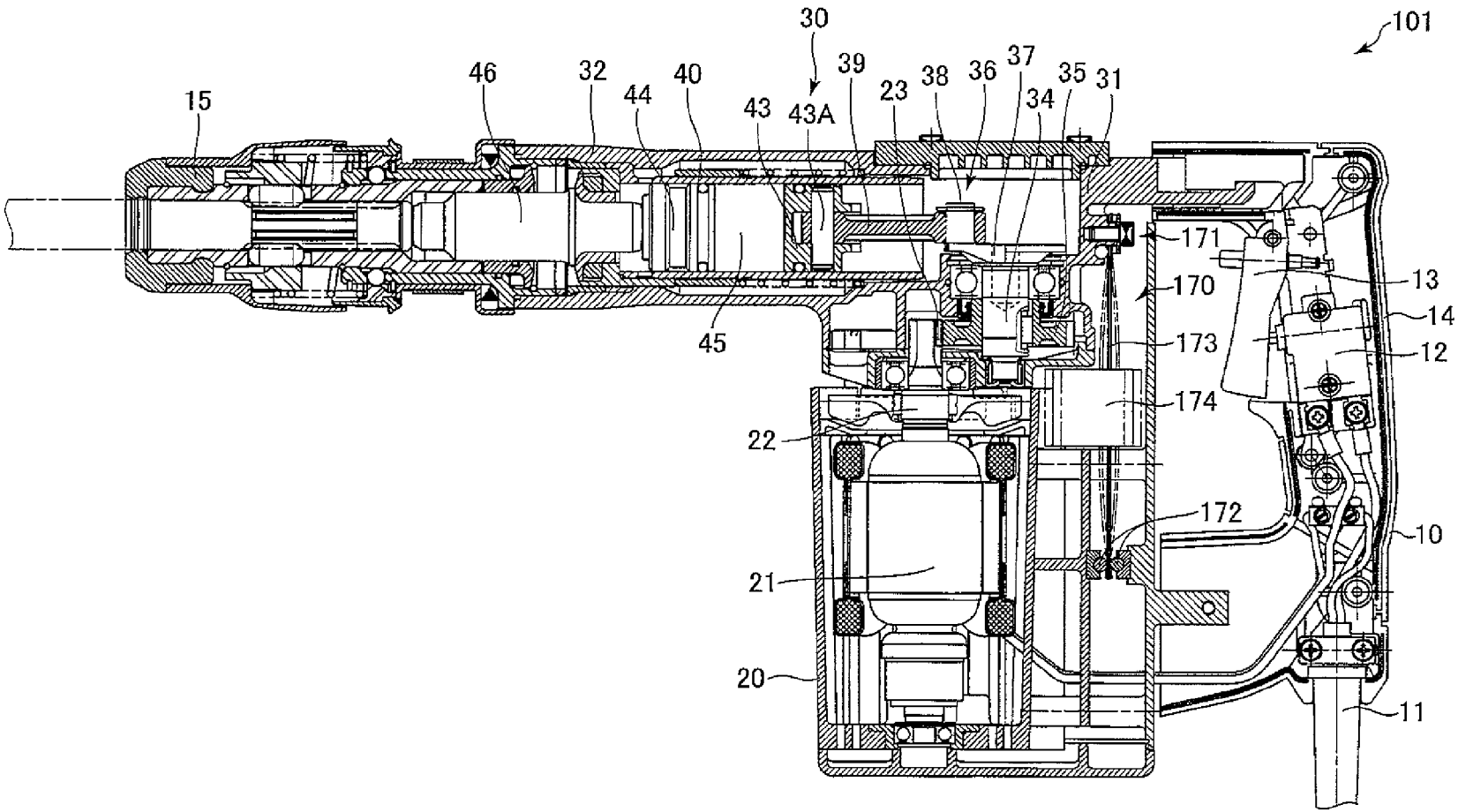
FIG. 3 is a cross-sectional view showing an impact tool according to a second embodiment of the present invention.
Figure 4:
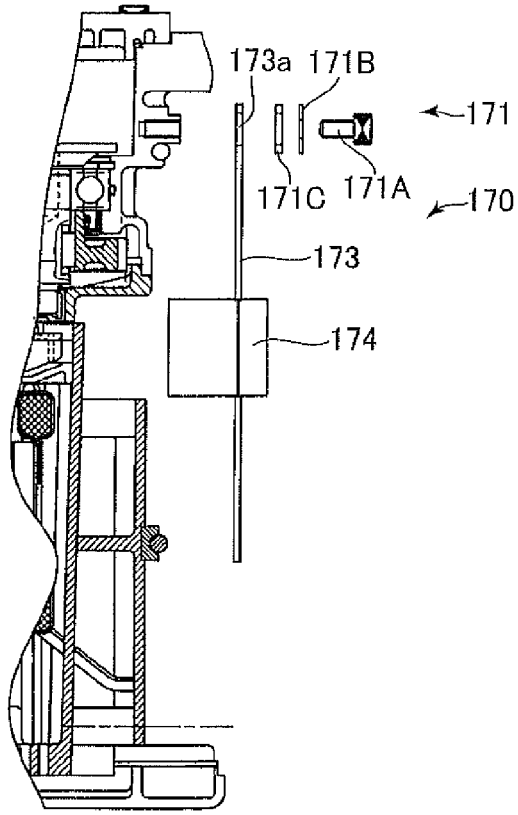
FIG. 4 is an exploded view showing a counterweight mechanism of the impact tool according to the second embodiment of the present invention.
Figure 5:
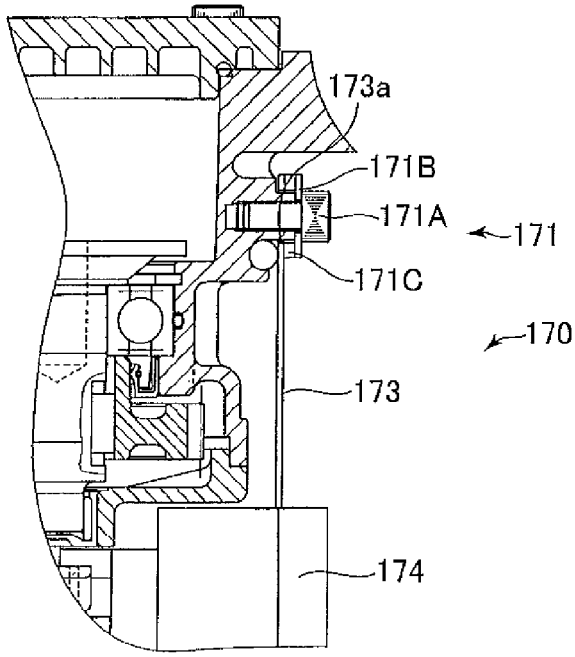
FIG. 5 is an enlarged view showing the counterweight mechanism of the impact tool according to the second embodiment of the present invention.

Next, an electrical power tool according to a second embodiment of the present invention will be described while referring to FIGS. 3 through 5. The electrical power tool of the present invention is applied to an impact tool 101. Like parts and components that are the same as those of the first embodiment will be assigned the same reference numerals to avoid duplicating descriptions, and only different aspects will be described. The impact tool 101 according to the second embodiment does not include the rotating cylinder 50 and the control unit 24 used in the impact tool 1 of the first embodiment. Therefore, no rotation is applied to the working tool during the operation of the impact tool 1, and the electrical motor 21 rotates at a fixed speed.

As in the impact tool 1 of the first embodiment, a counterweight mechanism 170 is provided in the motion conversion housing 31 and is disposed in opposition to the handle 10. The counterweight mechanism 170 includes a support member 171, a pair of support members 172, a counterweight holding member 173, and a counterweight 174. The support member 171 will be described while referring to FIGS. 4 and 5. The support member 171 includes a bolt 171A, a washer 171B, and a spacer 171C. The pair of support members 172 is made from rubber. The counterweight holding member 173 is made from a leaf spring and is formed with a bolt insertion hole 173*a*. The upper end portion of the counterweight holding member 173 is fixed to the motion conversion housing 31 by inserting the bolt 171A through the washer 171B, the spacer 171C, and the bolt insertion hole 173*a*. The lower end portion of the counterweight holding member 173 is positioned between the pair of the support members 172 and is supported by the support members 172 with line contacts. Since the support members 172 is made from rubber, the lower end portion of the counterweight holding member 173 is supported by the support members 172 while being capable of moving up and down with respect to the support members 172. The counterweight 174 is fixed roughly in the vertical center of the counterweight holding member 173.

The counterweight mechanism 170 of the second embodiment also can be efficiently reduced the vibration of the impact tool 101 caused by the reciprocation motion of the striking member 44. Also, as described above, the counterweight mechanism 170 includes the bolt 171A, the washer 171B, and the spacer 171C. Thus, by adjusting the tightness of the bolt 171A, the load applied to the upper end portion of the counterweight holding member 173 can be controlled. Hence, the vibration of the counterweight holding member 173 and the counterweight 174 can be controlled and the resonance frequency of the counterweight mechanism 170 can be adjusted. Other advantages of the impact tool 101 are similar to the advantages of the impact tool 1 according to the first embodiment.

Figure 6:
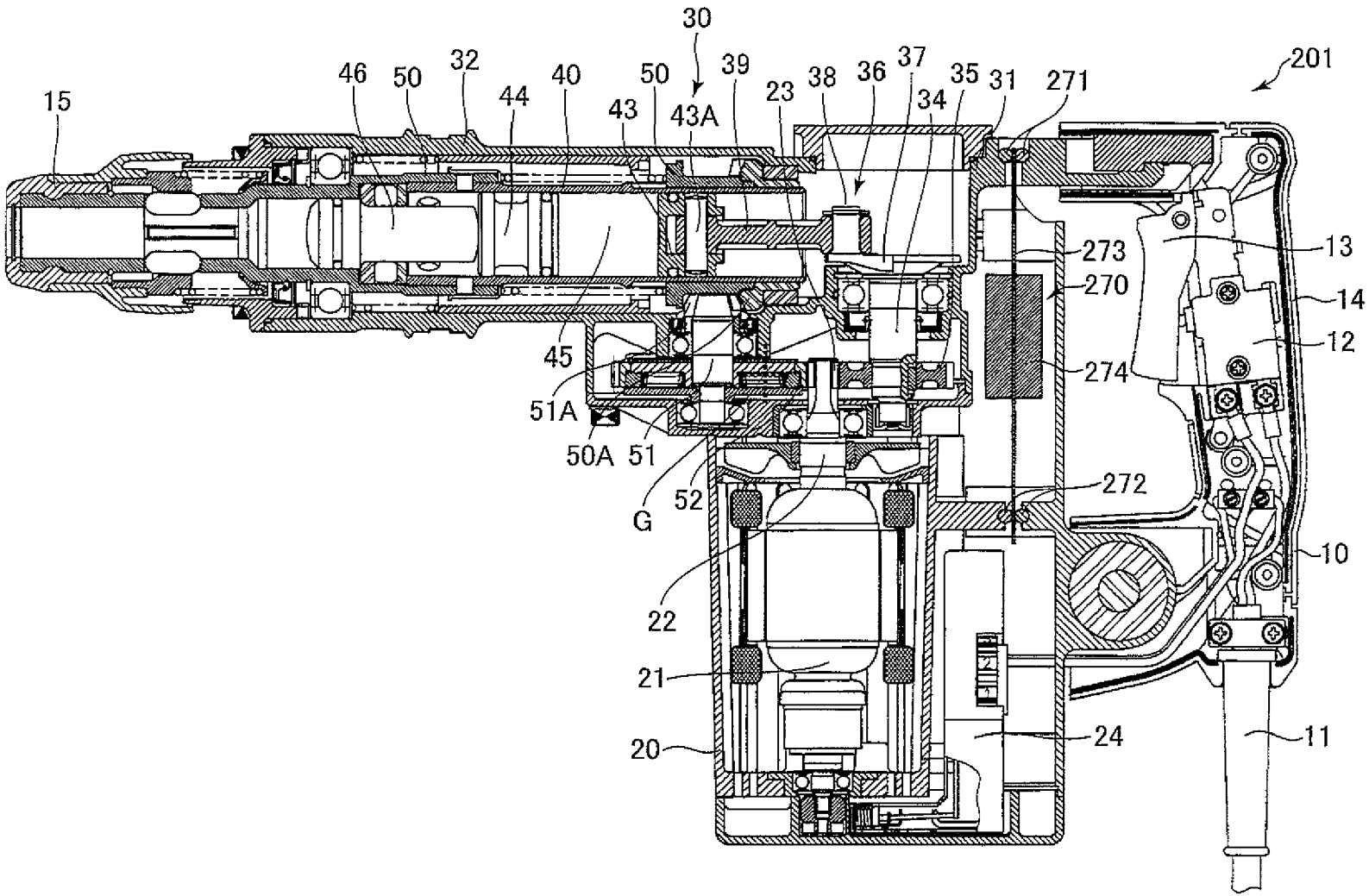
FIG. 6 is a cross-sectional view showing an impact tool according to a third embodiment of the present invention.

Next, an electrical power tool according to a third embodiment of the present invention will be described while referring to FIG. 6. The electrical power tool of the present invention is applied to an impact tool 201. Like parts and components that are the same as those of the first embodiment will be assigned the same reference numerals to avoid duplicating descriptions, and only different aspects will be described.

A counterweight mechanism 270 is provided in the motion conversion housing 31 and is disposed in opposition to the handle 10. The counterweight mechanism 270 is positioned above the control unit 24 and is also positioned above a line that passes through the center of gravity G of the impact tool 201 and that extends parallel to the directions of the reciprocation motion of the piston 43. The counterweight mechanism 270 includes a pair of support members 271, a pair of support members 272, a counterweight holding member 273, and a counterweight 274. The pair of support members 271 is made from rubber and is fixed to the upper section of the motion conversion housing 31. The pair of support members 272 is also made from rubber and is fixed to the motion conversion housing 31.

The counterweight holding member 273 is made from a leaf spring. The upper end portion of the counterweight holding member 273 is positioned between the pair of support members 271 and is supported by the support members 271 with line contacts. Since the pair of support members 271 is made from rubber, the upper end portion of the counterweight holding member 273 is supported by the support members 271 while being capable of moving up and down with respect to the support members 271. The lower end of the counterweight holding member 273 is positioned between the pair of support members 272 and is supported by the support members 272 with line contact. Since the pair of support members 272 is made from rubber, the lower end portion of the counterweight holding member 273 is supported by the support members 272 while being capable of moving up and down with respect to the support members 272. Thus, the counterweight 274 is doubly supported on both ends by the counterweight holding member 273. The counterweight 274 is fixed to roughly in the vertical center of the counterweight holding member 273.

The counterweight mechanism 270 according to the third embodiment also can be efficiently reduced the vibration of the impact tool 201 caused by the reciprocation motion of the striking member 44. Also, as described above, the counterweight mechanism 270 is positioned above the line that passes through the center of gravity G of the impact tool 201 and that extends parallel to the directions of the reciprocation motion of the piston 43. Therefore, the rotation moment centering on the center of gravity G caused by the reciprocation motion of the piston 43 can be reduced. Other advantages of the impact tool 201 are similar to the advantages of the impact tool 1 of the first embodiment.

Figure 7:
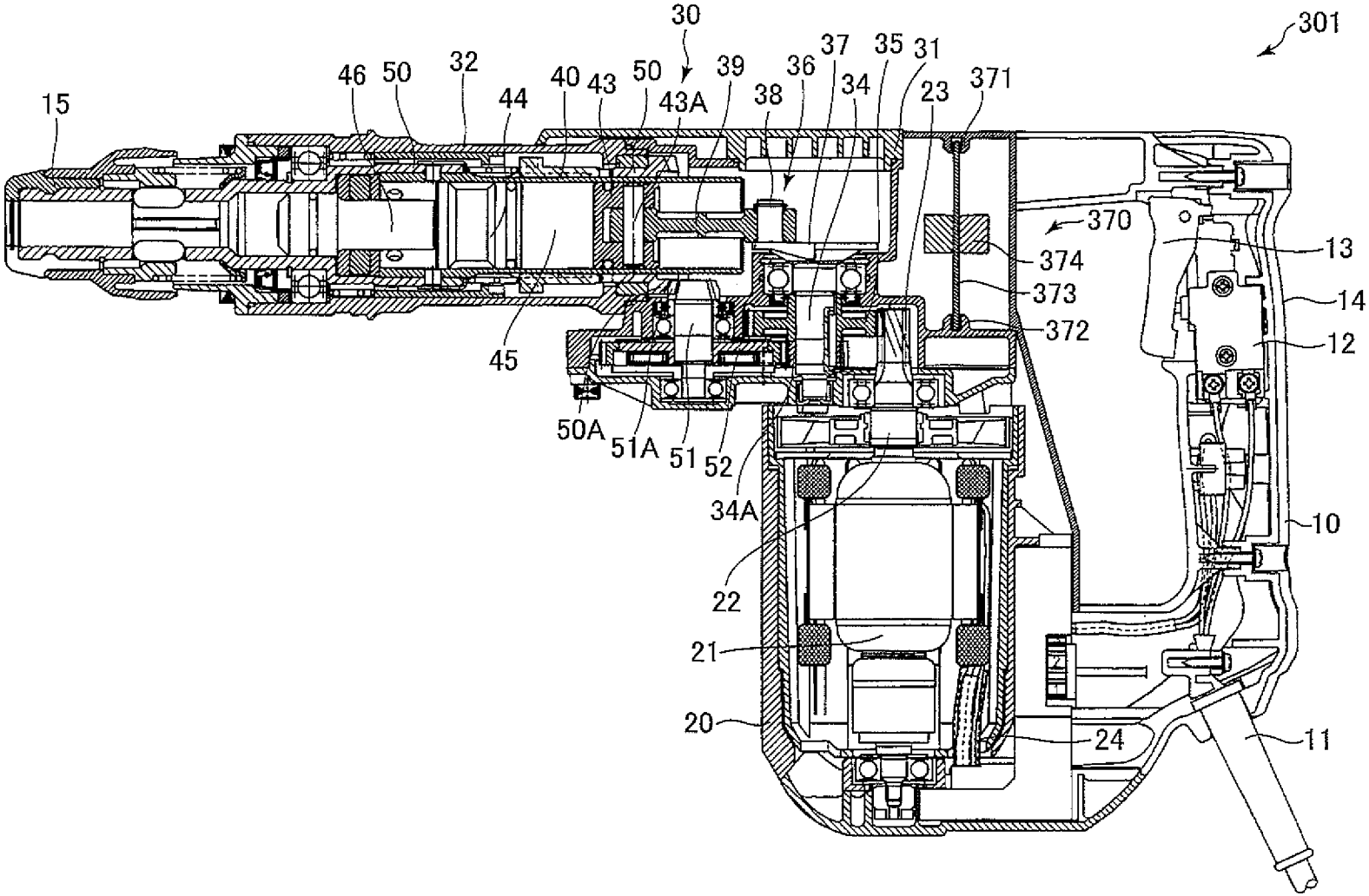
FIG. 7 is a cross-sectional view showing an impact tool according to a fourth embodiment of the present invention.

Next, an electrical power tool according to a fourth embodiment of the present invention will be described while referring to FIG. 7. The electrical power tool of the present invention is applied to an impact tool 301. Like parts and components that are the same as those of the first embodiment will be assigned the same reference numerals to avoid duplicating descriptions, and only different aspects will be described.

The crank shaft 34 is positioned at the front side of the pinion gear 23. A third gear 34A is coaxially fixed to the crank shaft 34 on the lower side of the first gear 35. The rotation transmission shaft 51 is positioned at the front side of the crank shaft 34. The second gear 52 is meshingly engaged with the third gear 34A. The rotation of the electrical motor 21 is transmitted to the rotation transmission shaft 51 by way of the pinion gear 23, the first gear 35, the third gear 34A, and the second gear 52. The rotation of the rotation transmission shaft 51 is transmitted to the rotating cylinder 50 by way of the first bevel gear 51A and the second bevel gear 50A, resulting in rotation of the rotating cylinder 50. The rotation of the rotating cylinder 50 applies a rotation force to a working tool (not shown).

A counterweight mechanism 370 is provided in a space above the electrical motor 21. The space is created by positioning the crank shaft 34 on the front side of the pinion gear 23. The counterweight mechanism 370 includes a support member 371, a support member 372, a counterweight holding member 373, and a counterweight 374. The support members 371 and 372 have a U-shaped, and the opening of the support member 371 opposes the opening of the support member 372 with each other. The counterweight holding member 373 is made from a leaf spring, and each end thereof is inserted into the openings of the support members 371 and 372, respectively. The counterweight holding member 373 is supported by the support members 371 and 372 with line contacts. The counterweight 374 is fixed to roughly in the vertical center of the counterweight holding member 373. Thus, the counterweight 374 is doubly supported on both ends by the counterweight holding member 373.

The counterweight mechanism 370 according to fourth embodiment also can be efficiently reduced the vibration of the impact tool 301 caused by the reciprocation motion of the striking member 44. Also, as described above, the counterweight mechanism 370 is positioned in a space above the electrical motor 21 created by positioning the crank shaft 34 on the front side of the pinion gear 23. Accordingly, the open space above the electrical motor 21 can be used efficiently and enlargement of the impact tool 301 by providing the counterweight mechanism 370 can be prevented. Other advantages of the impact tool 301 are similar to the advantages of the impact tool 1 according to the first embodiment.

Figure 8:
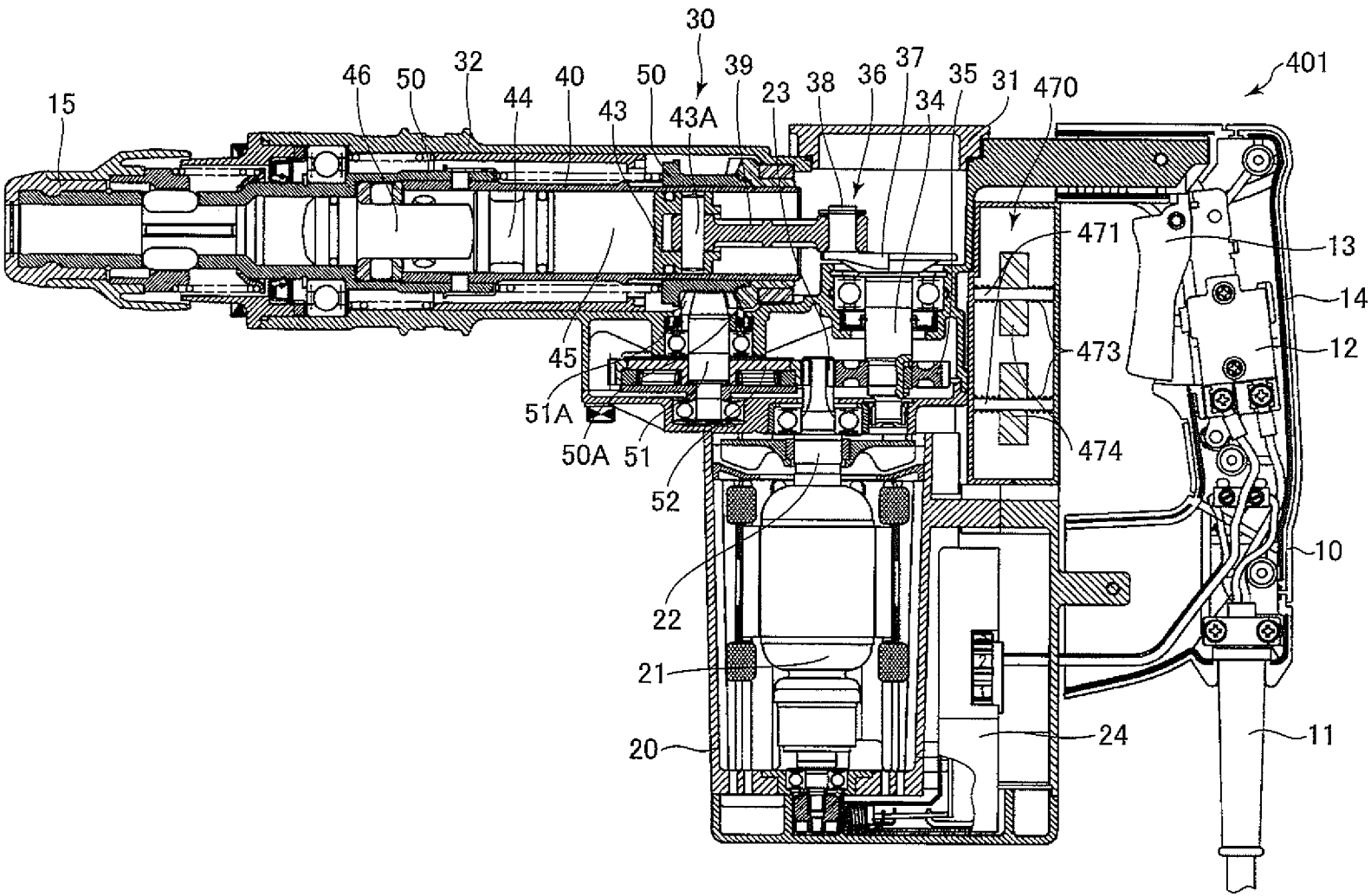
FIG. 8 is a cross-sectional view showing an impact tool according to a fifth embodiment of the present invention.

Next, an electrical power tool according to a fifth embodiment of the present invention will be described while referring to FIG. 8. The electrical power tool of the present invention is applied to an impact tool 401. Like parts and components that are the same as those of the first embodiment will be assigned the same reference numerals to avoid duplicating descriptions, and only different aspects will be described.

A counterweight mechanism 470 is provided above the control unit 24 and is disposed in opposition to the handle 10. The counterweight mechanism 470 includes two support members 471, four springs 473, and two counterweights 474. The two support members 471 extend parallel to the directions of the reciprocation motion of the piston 43 and are fixed to the motion conversion housing 31. Each of the two counterweights 474 is slidably supported by the support members 471, respectively. Each of the four springs 473 is positioned on each ends of the counterweights 474 and is interposed between the counterweights 474 and the motion conversion housing 31.

The counterweight mechanism 470 according to this embodiment also can be reduced efficiently the vibration of the impact tool 401, which is caused by the reciprocation motion of the striking member 44, by the vibration of the counterweights 474. Other advantages of the impact tool 401 are similar to the advantages of the impact tool 1 according to the first embodiment.

Figure 9:
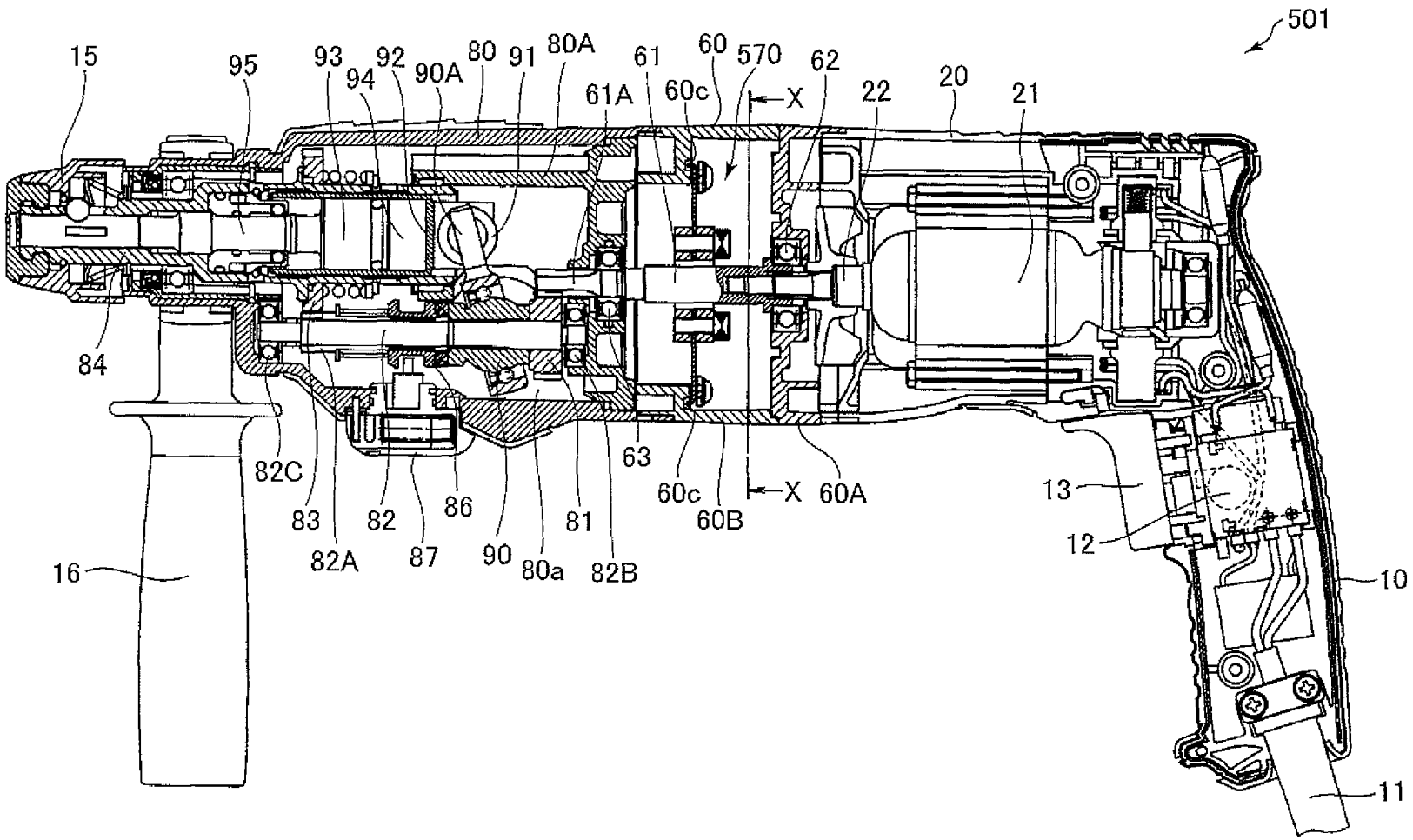
FIG. 9 is a cross-sectional view showing an impact tool according to a sixth embodiment of the present invention.
Figure 10:
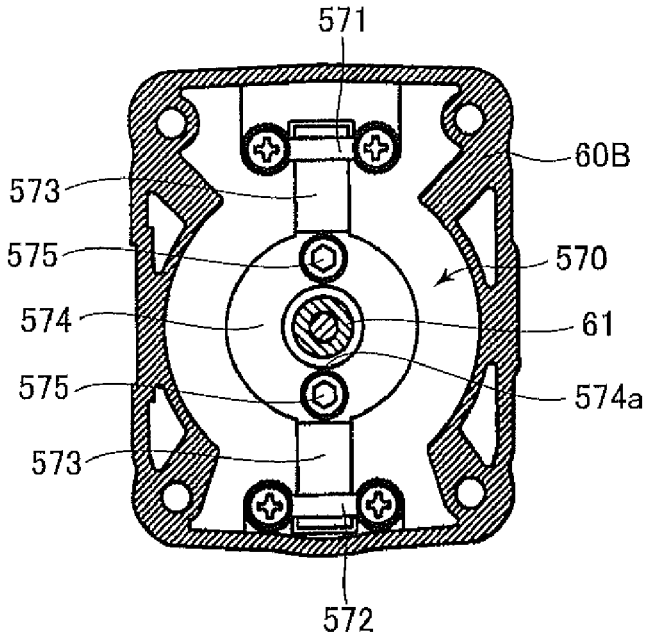
FIG. 10 is a cross-sectional view showing the impact tool taken along a line X-X in FIG. 9.

Next, an electrical power tool according to a sixth embodiment of the present invention will be described while referring to FIGS. 9 and 10. The electrical power tool of the present invention is applied to an impact tool 501. The impact tool 501 includes a casing having the handle 10, the motor housing 20, a weight housing 60, and a gear housing 80.

The power cable 11 is attached to the handle 10. The handle 10 houses the switch mechanism 12. The trigger 13 that can be manipulated by the user is mechanically connected to the switch mechanism 12. The switch mechanism 12 is connected to an external power source (not shown) through power cable 11. By operating the trigger 13, the switch mechanism 12 can be connected to and disconnected from the external power source.

The motor housing 20 is provided on the front side of the handle 10. The handle 10 and the motor housing 20 are formed integrally from plastic. The electrical motor 21 is accommodated in the motor housing 20. The electrical motor 21 includes the output shaft 22 and outputs rotational drive force.

The weight housing 60 is located on the front side of the motor housing 20 and is made from resin. The weight housing 60 includes a first weight housing 60A opposing the motor housing 20 and a second weight housing 60B opposing the gear housing 80. A first intermediate shaft 61 is provided in the weight housing 60 and extends in a direction that the output shaft 22 extends. The first intermediate shaft 61 is rotatably support by bearings 62 and 63. The rear end portion of the first intermediate shaft 61 is connected to the output shaft 22. The front end portion of the first intermediate shaft 61 is positioned in the gear housing 80 and is provided with a fourth gear 61A.

A counterweight mechanism 570 is provided in the weight housing 60. As shown in FIG. 10, which is a cross-sectional view taken along the X-X line in FIG. 9, the counterweight mechanism 570 includes support members 571 and 572, a pair of counterweight holding members 573, a counterweight 574, and a bolt 575. The support members 571 and 572 are provided at the upper and lower end portions of the second weight housing 60B, respectively. The pair of counterweight holding members 573 is made from leaf springs. As shown in FIG. 9, the upper and lower end portions of the counterweight holding members 573 have roughly an L-shaped, and each of the distal ends of the upper and lower end portions of the counterweight holding members 573 is positioned in each of recesses 60*c* formed in the second weight housing 60B, respectively. The upper end portion of the counterweight holding members 573 is supported by the support member 571, and the lower end portion of the counterweight holding members 573 is supported by the support member 572.

The counterweight 574 has a roughly circular cross-section and is formed with a shaft insertion hole 574*a* formed at the center thereof. The counterweight 574 is fixed to the counterweight holding members 573 by bolts 575. Hence, the counterweight 574 is doubly supported on its both ends by the pair of counterweight holding members 573. The first intermediate shaft 61 is inserted through the shaft insertion hole 574*a*.

The gear housing 80 is located on the front side of the second weight housing 60B and is made from resin. A metal partition member 80A is disposed in the gear housing 80 and partitions the gear housing 80 and the weight housing 60. The gear housing 80 and the partition member 80A forms a decelerating chamber 80*a*, which is a mechanism chamber accommodating a rotation transmission mechanism described later. A second intermediate shaft 82 is rotatably supported on the gear housing 80 and the partition member 80A via a bearings 82B and 82C, and extends parallel to the output shaft 22. A side handle 16 is provided near the tool support portion 15 of the gear housing 80, described later.

A fifth gear 81 meshingly engaged with the fourth gear 61A is coaxially fixed to the second intermediate shaft 82 on the electrical motor 21 side thereof. A gear 82A is formed on the front end portion of the second intermediate shaft 82 to be meshingly engaged with a sixth gear 83, described later. A cylinder 84 is provided above the second intermediate shaft 82 in the gear housing 80. The cylinder 84 extends parallel to the second intermediate shaft 82 and is rotatably supported on the partition member 80A. The sixth gear 83 is fixed to the outer periphery of the cylinder 84 and is meshingly engaged with the gear 82A described above so that the cylinder 84 can rotate around its central axial.

The tool support portion 15 mentioned above is provided on the front side of the cylinder 84, and a working tool (not shown) is capable of attaching to or detaching from the tool support portion 15. A clutch 86 is splined to the intermediate section of the second intermediate shaft 82. The clutch 86 is urged by a spring toward the electrical motor 21. The clutch 86 can be switched by means of a change lever 87 positioned below the gear housing 80 between a hammer drill mode (the position shown in FIG. 9) and a drill mode (with the clutch 86 moved toward the front). A motion converter 90 that converts rotational motion into reciprocation motion is rotatably provided on the outer periphery of the second intermediate shaft 82 on the electrical motor 21 side of the clutch 86. The motion converter 90 has an arm 90A that is capable of reciprocating back-and-forth the impact tool 501 as a result of the rotation of the second intermediate shaft 82.

When the clutch 86 is switched to the hammer drill mode using the change lever 87, the clutch 86 engages the second intermediate shaft 82 with the motion converter 90. The motion converter 90 is connected to and work with a piston 92 provided in the cylinder 84 through a piston pin 91. The piston 92 is slidably mounted in the cylinder 84 and is capable of a reciprocation motion parallel to the second intermediate shaft 82. A striking member 93 is provided in the piston 92 and is slidably provided along the inner periphery of the cylinder 84. An air chamber 94 is formed among the cylinder 84, the piston 92, and the striking member 93. An intermediate member 95 is supported in the cylinder 84 on the opposite side of the striking member 93 from the air chamber 94. The intermediate member 95 is slidably provided against the cylinder 84 along the direction of the motion of the piston 92. A working tool (not shown) is positioned on the opposite side of the intermediate member 95 from the striking member 93. Hence, the striking member 93 strikes the working tool (not shown) through the intermediate member 95.

Rotation output of the motor 21 is transmitted to the second intermediate shaft 82 by way of the first intermediate shaft 61, the fourth gear 61A, and the fifth gear 81. The rotation of the second intermediate shaft 82 is transmitted to the cylinder 84 by way of the meshing between the gear 82A and the sixth gear 83 mounted to the outer periphery of the cylinder 84. When the clutch 86 is in the hammer drill mode by operating the change lever 87, the clutch 86 is connected to the motion converter 90. Hence, the rotational driving force of the second intermediate shaft 82 is transmitted to the motion converter 90 through the clutch 86. The rotational driving force is converted to the reciprocation motion of the piston 92 on the motion converter 90 by way of the piston pin 91. The reciprocation motion of the piston 92 causes the pressure of the air inside the air chamber 94 formed between the striking member 93 and the piston 92 to repeatedly increase and decrease, thereby causing a reciprocation motion of the striking member 93. When the striking member 93 moves forward and collides with the rear end of the intermediate member 95, the impact force is applied to the working tool (not shown) through the intermediate element 95. In this manner, the rotational force and the impact force are simultaneously applied to the working tool (not shown) in the hammer drill mode.

If the clutch 86 is in the drill mode, the clutch 86 disengages the connection between the second intermediate shaft 82 and the motion converter 90, and only the rotational driving force of the second intermediate shaft 82 is transmitted to the cylinder 84 through the gear 82A and the sixth gear 83. Accordingly, only rotational force is applied to the working tool (not shown).

When the impact tool 501 according to sixth embodiment is operated, a vibration having a roughly constant frequency is generated in the impact tool 501 due to the reciprocation motion of the striking member 93. The vibration is transmitted to the support members 571 and 572 by way of the second weight housing 60B. The vibration transmitted to the support members 571 and 572 is transmitted to the counterweight holding members 573 and the counterweight 574, and the counterweight 574 vibrates in the same directions as the directions of the reciprocation motion of the piston 92. The vibration of the impact tool 501 can be reduced by the vibration of the counterweight 574, thereby improving the operation of the impact tool 501.

Although the present invention has been described with respect to specific embodiments, it will be appreciated by one skilled in the art that a variety of changes may be made without departing from the scope of the invention. For example, The pair of support members 72 of the impact tool 1 according to the first embodiment is made from steel roller, but the present invention is not limited to the steel roller. Any component having good sliding properties, e.g., an oil-impregnated metal, can be used.

Figure 11:
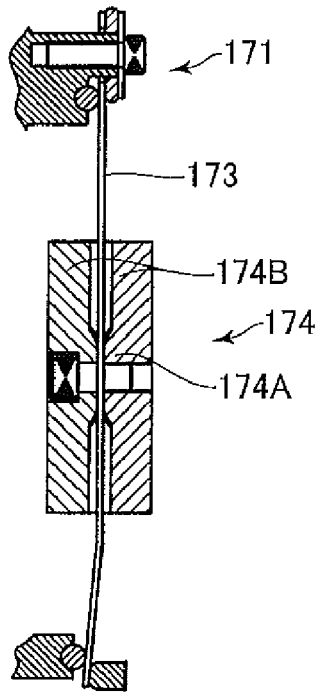
FIG. 11 is a cross-sectional view showing the counterweight mechanism of the impact tool according to a modification of the second embodiment.

In the second embodiment, it would also be possible as shown in FIG. 11 for the shape of the counterweight 174 to be, when the impact tool 101 is seen from the side, an "H" shape formed from: a base 174A extending in a direction perpendicular to the direction in which the weight support member 173 extends and secured to the weight support member 173; and two legs 174B extended from the ends of the base 174A, extending on either side of but separated from the weight support member 173. As a result, the length of the weight support member 173 needed to obtain a desired resonance frequency can be reduced, making it possible to provide a compact overall design for the counterweight unit.

What is claimed is:

1. An impact tool comprising:

a housing:

a motor having a rotation shaft, the motor being accommodated in the housing and generating a rotational drive force when powered;

a reciprocating motion converter configured to convert the rotational drive force of the motor to a reciprocating motion;

a tool bit attached to one end portion of the housing and driven by the reciprocating motion of the reciprocating motion converter;

a handle positioned at another end portion of the housing; and a counterweight mechanism operable to reduce vibrations generated attendant to the reciprocating motion, the counterweight mechanism being disposed in a section of the housing which is separated by a wall from the handle;

wherein the counterweight mechanism includes a counterweight supported at opposite ends thereof and extending in a direction transverse to a direction of the reciprocating motion.

2. The impact tool according to claim 1, further comprising a control substrate disposed in the housing and configured to control the rotational drive force generated by the motor, the control substrate being disposed in opposition to the section of the housing in which the counterweight mechanism is disposed.

3. The impact tool according to claim 2, wherein the control substrate is disposed between the motor and the handle, and the counterweight mechanism is disposed in opposition to the control substrate in a direction extending in parallel to the rotation shaft of the motor.

4. The impact tool according to claim 2, further comprising a transfer shaft interposed between the rotation shaft of the motor and the reciprocating motion converter, the transfer shaft transferring the rotational drive force generated by the motor to the reciprocating motion converter, wherein the counterweight mechanism is disposed between the transfer shaft and the handle.

5. The impact tool according to claim 1, wherein the handle comprises a grip, and wherein the counterweight is disposed between the grip and a center of gravity of the impact tool.

6. The impact tool according to claim 1, wherein the handle extends substantially in parallel to the rotation shaft of the motor, the handle comprising a grip, and the counterweight mechanism being disposed in opposition to and facing the grip.

7. The impact tool according to claim 6, wherein the counterweight extends in a direction substantially parallel to the rotation shaft of the motor.

8. The impact tool according to claim 1, wherein the counterweight mechanism is disposed in the section of the housing at a position below an upper part of the handle.

9. The impact tool according to claim 1, wherein the counterweight is disposed in the section of the housing at a position below an upper part of the handle.

10. The impact tool according to claim 1, wherein the counterweight is supported at the opposite ends by a leaf spring.

11. An impact tool comprising:

a housing:

a motor having a rotation shaft, the motor being accommodated in the housing and generating a rotational drive force when powered;

a reciprocating motion converter configured to convert the rotational drive force of the motor to a reciprocating motion;

a tool bit attached to one end portion of the housing and driven by the reciprocating motion of the reciprocating motion converter;

a handle positioned at another end portion of the housing;

a counterweight mechanism operable to reduce vibrations generated attendant to the reciprocating motion, the counterweight mechanism being disposed in a section of the housing which is separated by a wall from the handle;

wherein the counterweight mechanism includes a counterweight supported at opposite ends thereof and extending in a direction substantially parallel to an extension direction of the handle.

12. The impact tool according to claim 11, wherein the counterweight is supported at the opposite ends by a leaf spring.

13. An impact tool comprising:

a housing;

a motor having a rotation shaft, the motor being accommodated in the housing and generating a rotational drive force when powered;

a reciprocating motion converter configured to convert the rotational drive force of the motor to a reciprocating motion;

a tool bit attached to one end portion of the housing and driven by the reciprocating motion of the reciprocating motion converter;

a handle positioned at another end portion of the housing; and a counterweight mechanism operable to reduce vibrations generated attendant to the reciprocating motion, the counter weight mechanism being disposed in a section of the housing which is separated by a wall from the handle;

wherein the counterweight mechanism includes a counterweight supported by a leaf spring extending in a direction transverse to a direction of the reciprocating motion.

14. The impact tool according to claim 13, wherein the counterweight is supported at opposite ends by the leaf spring.

* * * * *